US006247454B1

(12) United States Patent
Fu

(10) Patent No.: US 6,247,454 B1
(45) **Date of Patent: *Jun. 19, 2001**

(54) ROCKER LEVER FOR AN INTERNAL COMBUSTION ENGINE FUEL INJECTION SYSTEM

(75) Inventor: Wayne C. Fu, Centerville, OH (US)

(73) Assignee: Cummins Engine Company, Inc., Columbus, IN (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/081,729

(22) Filed: May 20, 1998

(51) Int. Cl.[7] ..... F02M 37/04
(52) U.S. Cl. ..... 123/508; 123/467
(58) Field of Search ..... 123/508, 509, 123/467, 90.39, 507

(56) References Cited

U.S. PATENT DOCUMENTS

| | | | | |
|---|---|---|---|---|
| 1,346,401 | | 7/1920 | Ellis . | |
| 1,570,728 | | 1/1926 | Chandler . | |
| 4,182,289 | * | 1/1980 | Nakajima | 123/90.39 |
| 4,448,166 | * | 5/1984 | Amemori | 123/90.39 |
| 4,538,561 | * | 9/1985 | Amemori | 123/508 |
| 4,944,275 | | 7/1990 | Perr | 123/501 |
| 5,507,261 | * | 4/1996 | Johnson | 123/508 |
| 5,588,413 | * | 12/1996 | Stone | 123/508 |
| 5,647,325 | * | 7/1997 | Axbrink | 123/508 |
| 5,671,707 | * | 9/1997 | Purcell | 123/90.39 |
| 5,806,499 | * | 9/1998 | Stouer | 123/508 |
| 5,865,159 | * | 2/1999 | Henrikson | 123/90.39 |

FOREIGN PATENT DOCUMENTS

| | | |
|---|---|---|
| 96010 | 7/1923 | (AU) . |
| 63-170512 | of 1988 | (JP) . |

* cited by examiner

*Primary Examiner*—Carl S. Miller
(74) *Attorney, Agent, or Firm*—Woodard, Emhardt, Naughton, Moriarty & McNett

(57) ABSTRACT

The present invention relates to an improved fuel injector rocker lever designed to maintain relatively high fuel injection pressures when the engine speed decreases from full-rated power to torque peak conditions. The fuel injector rocker lever is designed with a size and shape so as to make the rocker lever flexible, thereby allowing the rocker lever to store and release strain energy when actuating the fuel injector. Thus, as engine speed decreases, the fuel injection pressure decreases at a lower rate when compared to a stiff actuating train because the fuel injector train is storing more strain energy due to its flexible nature. Generally, the improved rocker lever is designed with a vertically thin and horizontally wide arm which increases its width from the fuel injector actuator to the pivot point of the rocker lever. By reducing the thickness of the rocker lever, the stiffness decreases significantly, thereby permitting more strain energy to be stored and released by the rocker lever. Moreover, the stress experienced over the length of the lever arm is constant since the lever width increases away from the fuel injector contact point. Ultimately, the present design permits higher average fuel injection pressures during decreasing engine speed transients and therefore improves engine emissions.

16 Claims, 4 Drawing Sheets

Peak injection pressure is improved at RPM 1 (torque peak) with the reduced train stiffness.

ROCKER LEVER FOR AN INTERNAL COMBUSTION ENGINE FUEL INJECTION SYSTEM

TECHNICAL FIELD OF THE INVENTION

The present invention generally relates to internal combustion engine fuel injection systems and, more particularly, to an improved rocker lever for an internal combustion engine fuel injection system.

BACKGROUND OF THE INVENTION

In order to achieve good quality emissions from an internal combustion engine (i.e., fairly complete combustion of fuel with a low percentage emission of noxious substances in the engine exhaust), it is necessary to maintain the fuel injection pressure as high as possible. In most internal combustion engines which do not employ a common rail fuel injection system, the fuel injector comprises a translating plunger within the fuel injector body which is actuated by a camshaft that rotates in relation to the engine speed (usually at one-half engine speed). The camshaft operates upon a push rod which in turn moves a rocker lever that pushes on the plunger within the fuel injector, as is known in the art. At full-rated power, the internal combustion engine runs at a relatively high speed, which translates to a relatively high speed of the plunger within the fuel injector. This high-speed motion of the plunger in the fluid fuel creates extra injection pressure which helps to maintain emission quality. FIG. 1 illustrates a graph of fuel injection pressure versus engine RPM for a typical prior art internal combustion engine. It can be seen that at full-rated power (labeled RPM 2), the fuel injection pressure is relatively high at $P_{SAC2}$.

As the speed of the engine decreases to the torque peak condition (labeled RPM 1), this speed-induced injection pressure decreases, lowering the total fuel injection pressure to $P_{SAC1}$. Because of this lower fuel injection pressure, the quality of emissions produced by the engine also decreases at torque peak.

In order to improve the emission quality of the engine, it is therefore desirable to increase the fuel injection pressure created at torque peak conditions. The present invention is directed toward meeting this need.

SUMMARY OF THE INVENTION

The present invention relates to an improved fuel injector rocker lever designed to maintain relatively high fuel injection pressures when the engine speed decreases from full-rated power to torque peak conditions. The fuel injector rocker lever is designed with a size and shape so as to make the rocker lever flexible, thereby allowing the rocker lever to store and release strain energy when actuating the fuel injector. Thus, as engine speed decreases, the fuel injection pressure decreases at a lower rate when compared to a stiff actuating train because the fuel injector train is storing more strain energy due to its flexible nature. Generally, the improved rocker lever is designed with a vertically thin and horizontally wide arm which increases its width from the fuel injector actuator to the pivot point of the rocker lever. By reducing the thickness of the rocker lever, the stiffness decreases significantly, thereby permitting more strain energy to be stored and released by the rocker lever. Moreover, the stress experienced over the length of the lever arm is constant since the lever width increases away from the fuel injector contact point. Ultimately, the present design permits higher average fuel injection pressures during decreasing engine speed transients and therefore improves engine emissions.

In one form of the invention, a rocker lever is disclosed, comprising a pivot, a lever arm extending from said pivot, said lever arm having a substantially constant first thickness, a flange coupled to said lever arm opposite said pivot, said flange operable to actuate a fuel injector when said rocker lever is rotated about said pivot in a first direction, wherein said first thickness is such tat said lever arm flexes during actuation of said fuel injector.

In another form of the invention, a rocker lever is disclosed comprising a pivot, a flange, a lever arm extending between said pivot and said flange, said lever arm having a substantially constant first thickness and a width that increases with increasing distance from said flange, wherein said flange is operable to actuate a fuel injector when said rocker lever is rotated about said pivot in a first direction.

In another form of the invention, a fuel injection system for an internal combustion engine is disclosed, comprising at least one fuel injector, at least one rocker lever coupled to said at least one fuel injector, a camshaft operable to cause said at least one rocker lever to periodically actuate said at least one fuel injector, wherein each said at least one rocker lever comprises, a pivot a lever arm extending from said pivot, said lever arm having a substantially constant first thickness, a flange coupled to said lever arm opposite said pivot, said flange operable to actuate one of said at least one fuel injector when said rocker lever is rotated about said pivot in a first direction, wherein said first thickness is such that said lever arm flexes during activation of said one of said at least one fuel injector.

In another form of the invention, a fuel injection system for an internal combustion engine is disclosed, comprising at least one fuel injector, at least one rocker lever coupled to said at least one fuel injector, a camshaft operable to cause said at least one rocker lever to periodically actuate said at least one fuel injector, wherein each said at least one rocker lever comprises, a pivot, a flange, a lever arm extending between said pivot and said flange, said lever arm having a substantially constant first thickness and a width that increases with increasing distance from said flange, wherein said flange is operable to actuate one of said at least one fuel injector when said rocker lever is rotated about said pivot in a first direction.

DETAILED DESCRIPTION OF THE PREFERRED EMBODIMENTS

Figure 1:
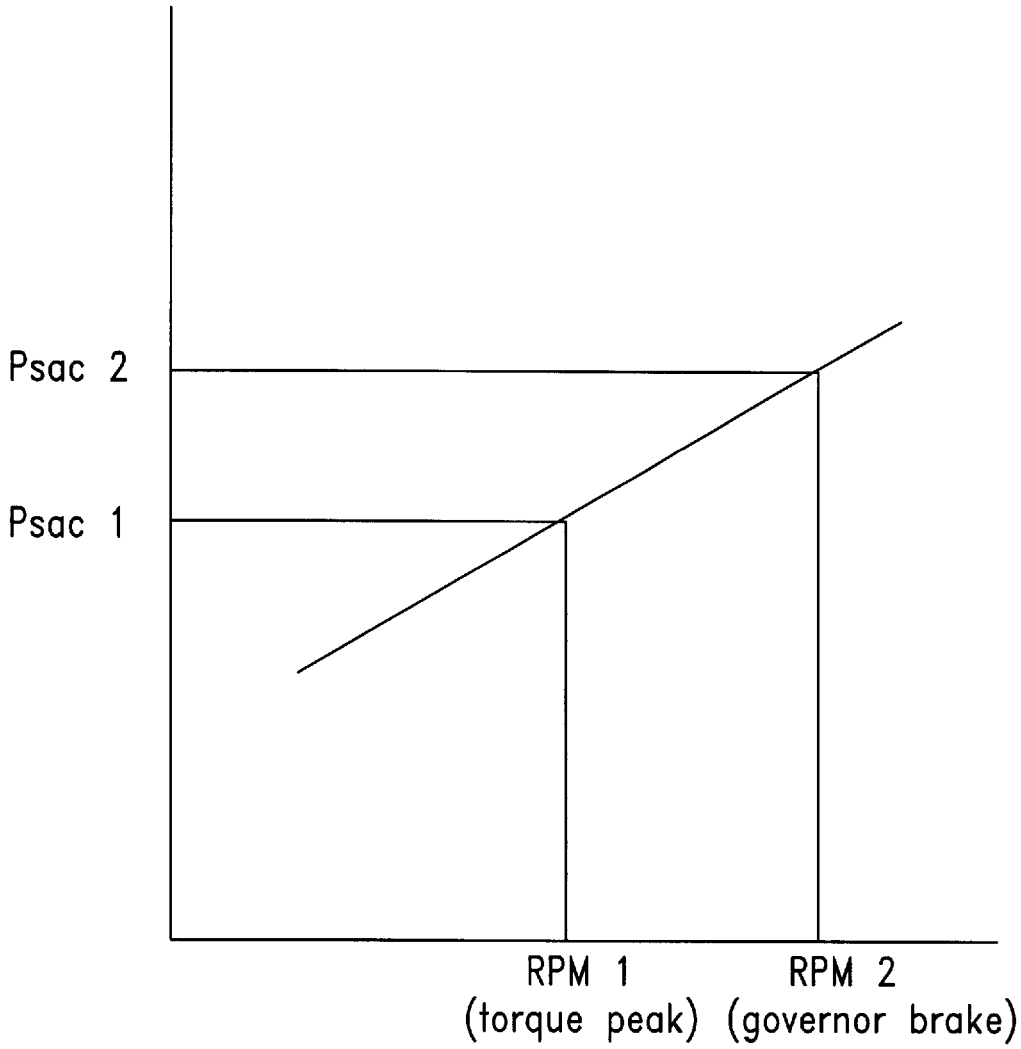
Fig. 1 (PRIOR ART)
FIG. 1 is a schematic graph of fuel injection pressure versus engine speed for a prior art fuel injection actuation train.

For the purpose of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

In order to compensate for part of the loss in fuel injection pressure as a result of a speed decrease of the internal combustion engine, it has been determined by the present inventor that a more flexible fuel injector actuating train is desired. This is because a more flexible fuel injector actuating train is less sensitive to engine speed in that, as the engine speed decreases, the fuel injection pressure decreases at a lower rate compared to a stiff actuating train because the flexible actuating train can store and release more strain energy.

Figure 2:
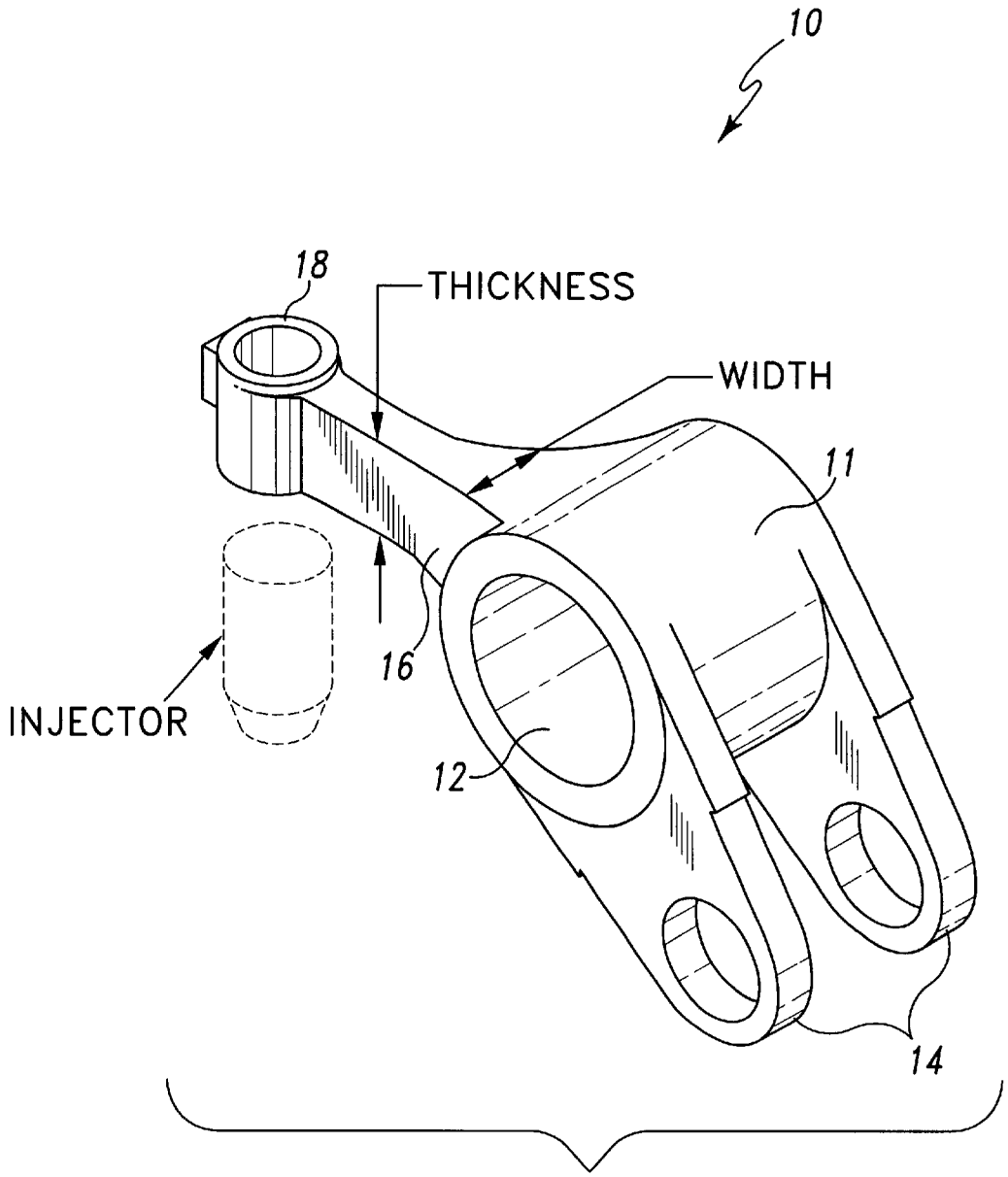
FIG. 2 is a perspective view of a preferred embodiment rocker lever of the present invention.

In a typical fuel injector actuating train, the component which can most readily be provided with increased flexibility is the rocker lever. Traditionally, the rocker lever is designed thick in the vertical direction and narrow in the horizontal direction, which leads to a stiff and high-strength lever. These have traditionally been thought of as desirable attributes for a fuel injector actuating train rocker lever. However, in order to increase the quality of emissions at lower engine speeds, the present invention provides a vertically thin and horizontally wide and flared rocker lever, as illustrated in FIG. 2 and indicated generally at 10. The rocker lever 10 includes a cylinder 11 having horizontal bore 12 which is used to mount the rocker lever 10 in a fixed position and provide a pivot point for the rocker lever 10. Two flanges 14 extend from a rocker lever 10 in order to provide coupling to the push rod (not shown) that is actuated by the camshaft (not shown). However, the present invention comprehends any means for providing rocking motion to the rocker lever 10, including direct actuation upon the rocker lever 10 by the engine camshaft.

On the opposite side of the rocker lever 10 from the mounting flanges 14, there extends a lever arm 16 which terminates in a fuel injector actuating flange 18. The present invention is concerned mainly with the design of the lever arm 16 between the pivot point 12 and the fuel injector actuating flange 18.

For the purposes of the present discussion, the terms "width" and "thickness" will be defined as indicated in FIG. 2. The stiffness of the lever arm 16 is a function of the third order of the lever thickness. By reducing the lever thickness, the stiffness of the lever arm 16 decreases significantly. A reduced stiffness in the lever arm 16 translates to a greater ability of the rocker lever 10 to store and release strain energy, thereby creating higher fuel injection pressures at lower engine speeds. However, it is necessary that the decrease in the thickness of the lever arm 16 does not reduce the reliability of the rocker lever 10. Therefore, the stress placed upon the lever arm 16 of the rocker lever 10 of the present invention is designed to remain substantially constant along the length of the lever arm 16 from the fuel injector actuation flange 18 to the cylinder 11. This is done by increasing the width of the rocker lever 16 with increasing distance from the fuel injector actuating flange 18. The stress upon the lever arm 16 is given by:

stress=MC/I where M=the bending moment

C=a constant

I=the area moment of inertia for any cross-section of the lever arm 16.

Figure 3A:
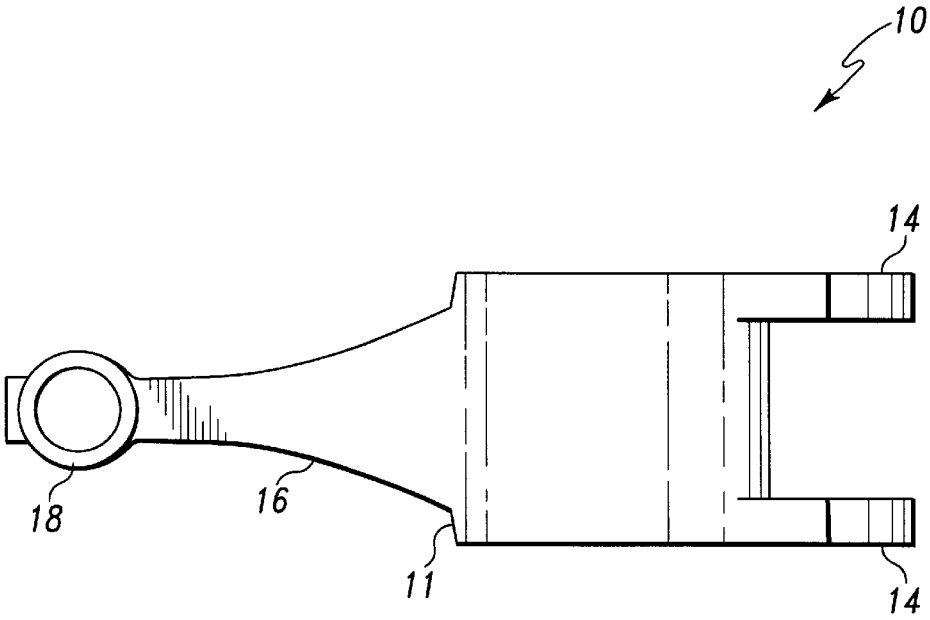
FIGS. 3A and B are respective top and side views of the preferred embodiment rocker lever of the present invention.
Figure 3B:
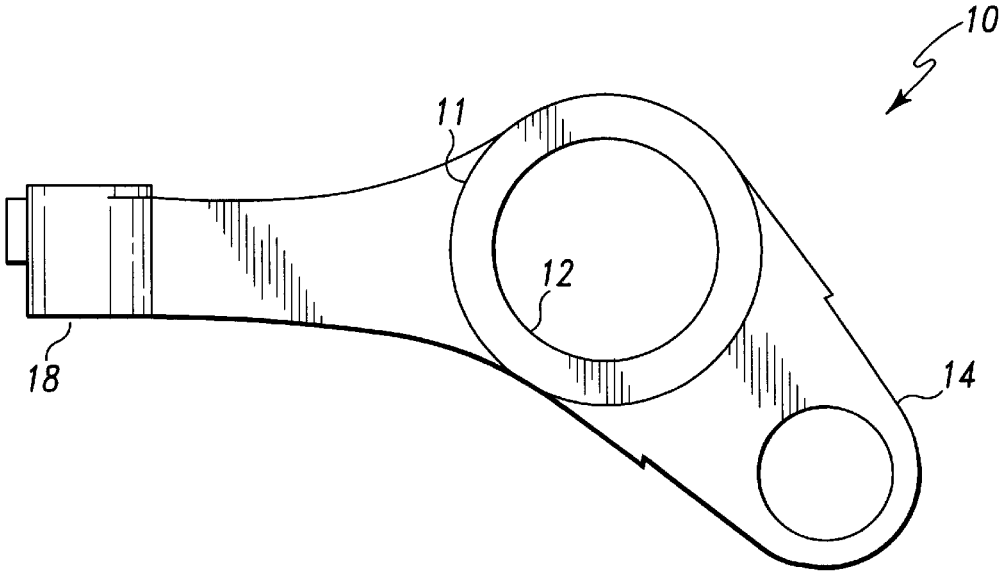

Because the moment of inertia for any cross-section of the lever arm 16 is a linear function of the width of the lever arm 16, as M increases, I also increases, resulting in a constant stress along the entire length of the lever arm 16. Top and side views of the rocker lever 10 are shown in FIGS. 3A and B, respectively. The present invention therefore provides for a rocker lever having a lever arm 16 of substantially constant thickness, where this thickness is such that the lever arm 16 is able to flex during its normal operation upon the fuel injector. The present invention also provides for a rocker lever having a width that increases with increasing distance from the fuel injector actuating flange 18 in the region of substantially constant thickness. It will be appreciated with reference to FIGS. 3A–B that the lever arm 16 may exhibit a region of substantially constant thickness and increasing width, followed by a transition to the thickness of the cylinder 11, wherein this transition region is not considered to be part of the lever arm 16, but instead part of the pivot cylinder 11. The width of the lever arm 16 may increase in any fashion, such as linearly, parabolically, exponentially, or even in a manner not defined by a function.

Figure 4:
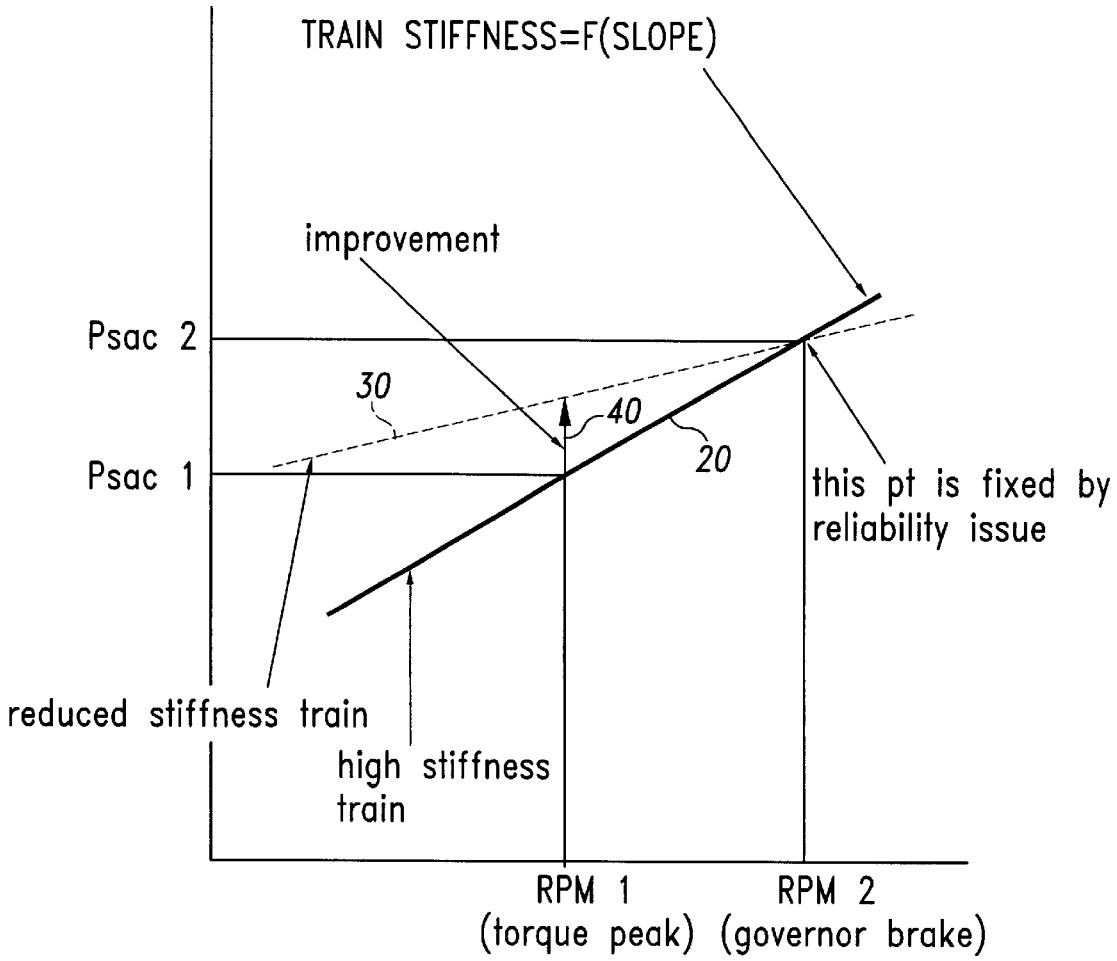
FIG. 4 is a schematic graph of fuel injection pressure versus engine speed, comparing the performance of a typical prior art device to the performance of the rocker lever of the present invention.

Referring now to FIG. 4, there is schematically illustrated a graph of fuel injection pressure versus engine speed. The solid line 20 represents the performance of the prior art high stiffness fuel injector actuating train of the prior art, as discussed hereinabove with respect to FIG. 1. It should be noted with reference to FIG. 4 that the slope of this line is a function of the stiffness of the fuel injector actuating train. The dotted line 30 illustrates the performance of the reduced stiffness fuel injector actuating train employing the rocker lever 10 of the present invention. As is readily apparent from the graph of FIG. 4, the slope (i.e., train stiffness) of the line 30 is much less than that of the line 20, thereby providing for a fuel injection pressure which decreases at a much lower rate with decreasing engine speed than is the case for the prior art actuating train which produced the line 20. The amount of improvement in fuel injection pressure at torque peak conditions is illustrated by the segment 40. Commensurate with this increased fuel injection pressure at the torque peak engine speed is an increase in the quality of emissions of the vehicle. The reduced stiffness rocker lever of the present invention therefore provides for enhanced emission quality at all engine speeds (except at full-rated power) than is the case for the prior art fuel injection actuating train.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A fuel injection system for an internal combustion engine, comprising:

at least one fuel injector;

at least one rocker lever coupled to said at least one fuel injector; and a camshaft operable to cause said at least one rocker lever to periodically actuate said at least one fuel injector;

wherein each said at least one rocker lever comprises:

a pivot;

a flange;

a lever arm extending between said pivot and said flange, said lever arm having a substantially constant first thickness and a width that increases with increasing distance from said flange;

wherein said substantially constant first thickness is a thickness of a cross-section of said lever arm through a plane parallel to a plane of said lever arm's rotation about said pivot; and wherein said flange is operable to actuate one of said at least one fuel injector when said rocker lever is rotated about said pivot in a first direction.

2. The fuel injection system of claim 1, wherein said pivot comprises:

a cylinder having a hollow cylindrical bore therethrough, said cylinder having a second thickness;

a transition region extending from one side of said cylinder, said transition region having a variable thickness that transitions from said second thickness on one end of said transition region to said first thickness on another end of said transition region.

3. The fuel injection system of claim 1, wherein said first thickness is such that said lever arm flexes during actuation of said fuel injector.

4. The fuel injection system of claim 1, wherein said width increases linearly with increasing distance from said flange.

5. A rocker lever, comprising:

a pivot;

a lever arm extending from said pivot, said lever arm having a substantially constant first thickness;

a flange coupled to said lever arm opposite said pivot, said flange operable to actuate a fuel injector when said rocker lever is rotated about said pivot in a first direction;

wherein said first thickness is positioned between said pivot and said flange; and wherein said first thickness is such that a portion of said lever arm between said pivot and said flange flexes during actuation of said fuel injector.

6. The rocker lever of claim 5, wherein said pivot comprises:

a cylinder having a hollow cylindrical bore therethrough, said cylinder having a second thickness;

a transition region extending from one side of said cylinder, said transition region having a variable thickness that transitions from said second thickness on one end of said transition region to said first thickness on another end of said transition region.

7. The rocker lever of claim 5, wherein said lever arm has a width that increases with increasing distance from said flange.

8. The rocker lever of claim 7, wherein said width increases linearly with increasing distance from said flange.

9. A rocker lever, comprising:

a pivot;

a flange;

a lever arm extending between said pivot and said flange, said lever arm having a substantially constant first thickness and a width that increases with increasing distance from said flange;

wherein said substantially constant first thickness is a thickness of a cross-section of said lever arm through a plane parallel to a plane of said lever arm's rotation about said pivot; and wherein said flange is operable to actuate a fuel injector when said rocker lever is rotated about said pivot in a first direction.

10. The rocker lever of claim 9, wherein said pivot comprises:

a cylinder having a hollow cylindrical bore therethrough, said cylinder having a second thickness;

a transition region extending from one side of said cylinder, said transition region having a variable thickness that transitions from said second thickness on one end of said transition region to said first thickness on another end of said transition region.

11. The rocker lever of claim 9, wherein said first thickness is such that said lever arm flexes during actuation of said fuel injector.

12. The rocker lever of claim 9, wherein said width increases linearly with increasing distance from said flange.

13. A fuel injection system for an internal combustion engine, comprising:

at least one fuel injector;

at least one rocker lever coupled to said at least one fuel injector; and a camshaft operable to cause said at least one rocker lever to periodically actuate said at least one fuel injector;

wherein each said at least one rocker lever comprises:

a pivot;

a lever arm coupled to and extending from said pivot, said lever arm having a substantially constant first thickness; and a flange coupled to said lever arm opposite said pivot, said flange operable to actuate one of said at least one fuel injector when said rocker lever is rotated about said pivot in a first direction;

wherein said first thickness is such that said lever arm flexes during activation of said one of said at least one fuel injector.

14. The fuel injection system of claim 13, wherein said pivot comprises:

a cylinder having a hollow cylindrical bore therethrough, said cylinder having a second thickness;

a transition region extending from one side of said cylinder, said transition region having a variable thickness that transitions from said second thickness on one end of said transition region to said first thickness on another end of said transition region.

15. The fuel injection system of claim 13, wherein said lever arm has a width that increases with increasing distance from said flange.

16. The fuel injection system of claim 15, wherein said width increases linearly with increasing distance from said flange.

* * * * *